US009809987B2

(12) United States Patent
Koch et al.

(10) Patent No.: US 9,809,987 B2
(45) Date of Patent: Nov. 7, 2017

(54) SEATING SYSTEM WITH TILTABLE DECK AND BELT DRIVE

(71) Applicant: ROGERS ATHLETIC COMPANY, INC., Clare, MI (US)

(72) Inventors: Joshua William Koch, Clare, MI (US); Brian Staten, Clare, MI (US); Todd Alan Swarts, Clare, MI (US); Timothy John Hockemeyer, Midland, MI (US)

(73) Assignee: ROGERS ATHLETIC COMPANY, INC., Clare, MI (US)

( * ) Notice: Subject to any disclaimer, the term of this patent is extended or adjusted under 35 U.S.C. 154(b) by 0 days.

(21) Appl. No.: 15/061,610

(22) Filed: Mar. 4, 2016

(65) Prior Publication Data

US 2016/0186454 A1 Jun. 30, 2016

Related U.S. Application Data

(63) Continuation of application No. 14/529,574, filed on Oct. 31, 2014, now Pat. No. 9,332,846.

(60) Provisional application No. 61/901,065, filed on Nov. 7, 2013.

(51) Int. Cl.

| | |
|---|---|
| ***E04H 3/12*** | (2006.01) |
| ***A47C 1/126*** | (2006.01) |
| ***A47C 1/121*** | (2006.01) |
| ***A47C 1/124*** | (2006.01) |
| ***B66D 1/20*** | (2006.01) |
| ***B66D 1/60*** | (2006.01) |

(52) U.S. Cl.

CPC ..... *E04H 3/123* (2013.01); *A47C 1/121* (2013.01); *A47C 1/124* (2013.01); *A47C 1/126* (2013.01); *B66D 1/20* (2013.01); *B66D 1/60* (2013.01)

(58) Field of Classification Search

CPC ..... E04H 3/126; E04H 3/123; E04H 3/12; A47C 1/12; A47C 1/126

See application file for complete search history.

(56) References Cited

U.S. PATENT DOCUMENTS

| | | | | |
|---|---|---|---|---|
| 2,183,056 | A | 12/1939 | Albach et al. | |
| 2,449,829 | A * | 9/1948 | Agren | B65G 69/30 14/69.5 |
| 2,706,835 | A | 4/1955 | Ullom | |
| 2,968,842 | A | 1/1961 | Murphy | |
| 2,990,587 | A | 7/1961 | Murphy | |
| 3,222,827 | A | 12/1965 | Smith | |
| 3,389,511 | A | 6/1968 | Drehobl | |
| 3,429,081 | A | 2/1969 | McClelland | |
| 3,667,171 | A | 6/1972 | McClelland et al. | |
| 3,738,612 | A | 6/1973 | Hartman | |
| 3,743,131 | A | 7/1973 | Swett et al. | |
| 3,881,140 | A | 4/1975 | Hartman | |
| 4,041,655 | A | 8/1977 | Pari | |
| 4,155,202 | A | 5/1979 | Hartman | |
| 4,189,876 | A | 2/1980 | Crossman et al. | |

(Continued)

*Primary Examiner* — Rodney Mintz
*Assistant Examiner* — Daniel Kenny
(74) *Attorney, Agent, or Firm* — Carlson, Gaskey & Olds, P.C.

(57) ABSTRACT

A seating system according to an exemplary aspect of the present disclosure includes, among other things, a riser including a tiltable deck. Another seating system according to the present disclosure includes, among other things, a drive system for moving a riser. The drive system includes a sprocket configured to engage a belt.

15 Claims, 18 Drawing Sheets

(56) References Cited

U.S. PATENT DOCUMENTS

| | | | | |
|---|---|---|---|---|
| 4,367,612 | A | 1/1983 | Sutter | |
| 4,490,949 | A | 1/1985 | Sutter et al. | |
| 4,909,000 | A | 3/1990 | Mackintosh | |
| 5,069,007 | A | 12/1991 | Paddock | |
| 5,517,091 | A | 5/1996 | Becher et al. | |
| 5,660,000 | A | 8/1997 | MacIntyre | |
| 5,921,031 | A | 7/1999 | Williams | |
| 5,979,125 | A | 11/1999 | Guillet | |
| 6,055,780 | A | 5/2000 | Yamazaki | |
| 6,199,325 | B1 | 3/2001 | Winship | |
| 6,293,053 | B1 | 9/2001 | Norman | |
| 6,324,790 | B1 | 12/2001 | Victor et al. | |
| 6,415,551 | B1 | 7/2002 | Norman | |
| 6,625,932 | B1 | 9/2003 | Littlefield | |
| 6,743,131 | B1 | 6/2004 | Walker | |
| 7,900,402 | B2 | 3/2011 | Staten et al. | |
| 7,986,416 | B2 | 7/2011 | Chiu | |
| 8,484,903 | B2 * | 7/2013 | Koch | E04H 3/123 52/9 |
| 8,528,971 | B2 | 9/2013 | Bilodeau et al. | |
| 2003/0009950 | A1 | 1/2003 | Hallberg | |
| 2004/0035060 | A1 | 2/2004 | Miyazaki et al. | |
| 2004/0128918 | A1 | 7/2004 | Yang et al. | |
| 2008/0083170 | A1 | 4/2008 | Staten et al. | |
| 2008/0190038 | A1 | 8/2008 | Jacobs et al. | |
| 2010/0183388 | A1 | 7/2010 | Chiu | |
| 2010/0192477 | A1 | 8/2010 | Wisner et al. | |
| 2011/0016798 | A1 | 1/2011 | Jacobs et al. | |
| 2011/0099915 | A1 | 5/2011 | Sudkamp et al. | |
| 2011/0107682 | A1 | 5/2011 | Staten et al. | |
| 2014/0259986 | A1 * | 9/2014 | Kwartler | E04H 12/182 52/118 |

* cited by examiner

SEATING SYSTEM WITH TILTABLE DECK AND BELT DRIVE

RELATED APPLICATIONS

This application is a continuation of prior U.S. application Ser. No. 14/529,574, filed Oct. 31, 2014, which claims the benefit of U.S. Provisional Application No. 61/901,065, filed Nov. 7, 2013. The '574 application and the '065 provisional application are herein incorporated by reference in their entirety.

BACKGROUND

Seating risers are often used in auditoriums, gymnasiums, stadiums, and event halls, as examples, to accommodate spectators on portable seats, such as folding chairs, or on seats that are affixed to the risers. Certain facilities may require seating risers that are capable of being moved between a retracted position for storage and a deployed position for use.

SUMMARY

A seating system according to an exemplary aspect of the present disclosure includes, among other things, a riser including a tiltable deck.

Another seating system according to the present disclosure includes, among other things, a drive system for moving a riser. The drive system includes a sprocket configured to engage a belt.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The drawings can be briefly described as follows.

DETAILED DESCRIPTION

Figure 1A:
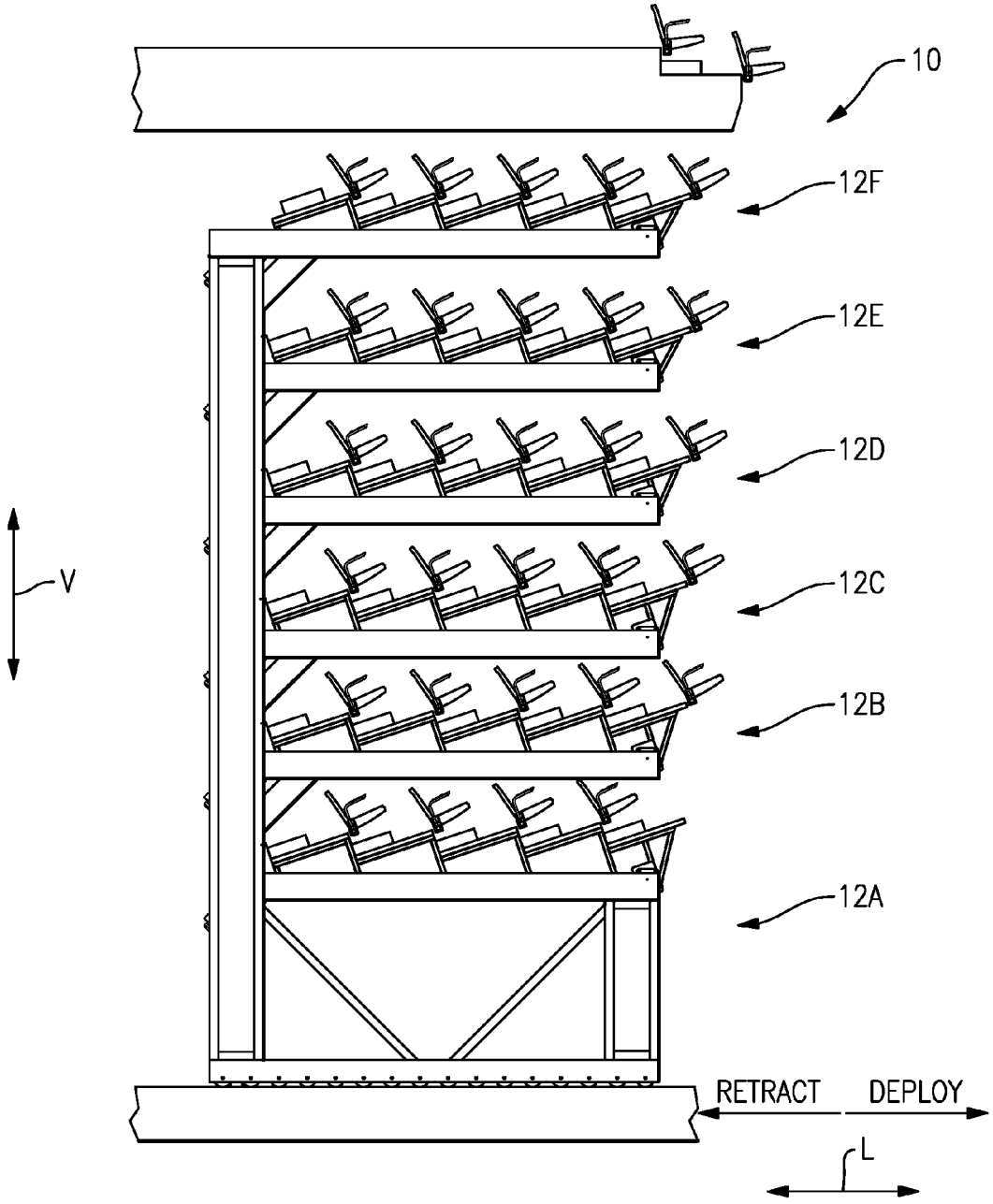
FIG. 1A is a side view of a seating system in a retracted position.
Figure 1B:
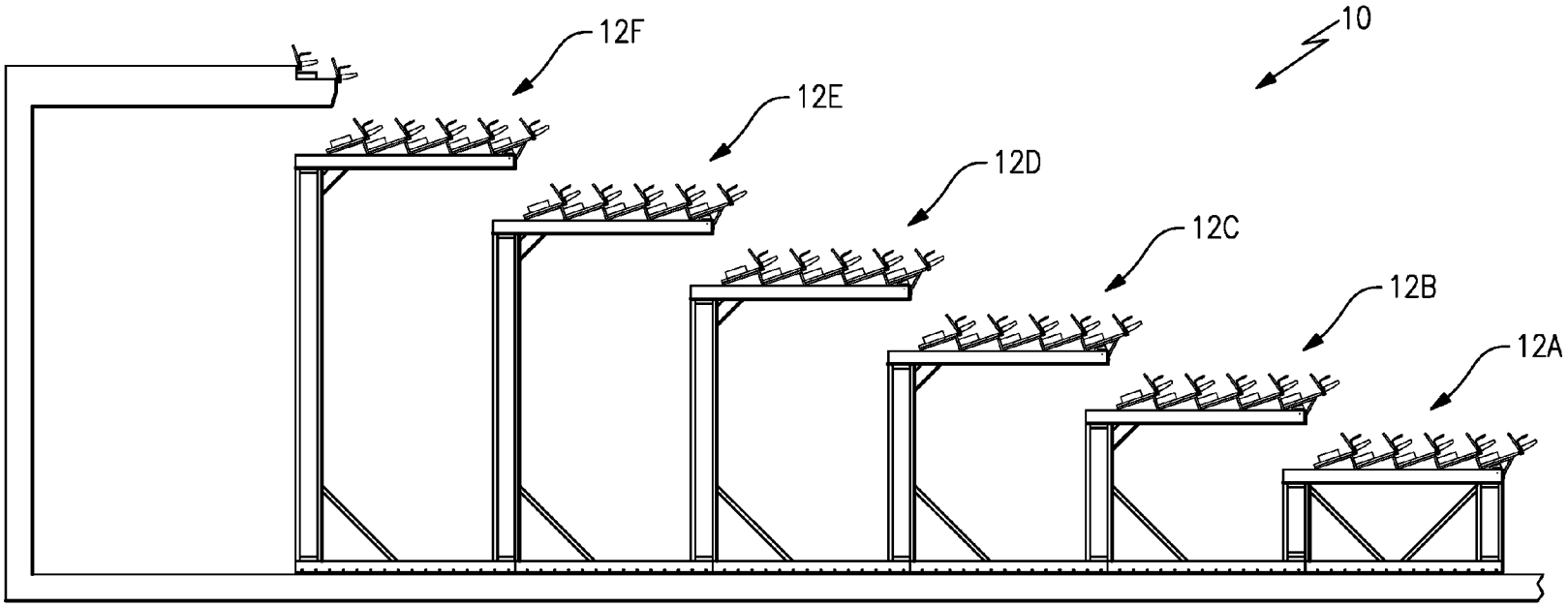
FIG. 1B is a side view of the seating system of FIG. 1A in a deployed position, with the decks of the seating system in a stored position.

An example seating system 10 is illustrated across FIGS. 1A-1E. The example seating system 10 includes a plurality of telescopic seating risers 12A-12F configured to telescope relative to one another when moving in a longitudinal direction L between a rearward, retracted position (FIG. 1A) and a forward, deployed position (FIG. 1B). In most examples, the longitudinal direction L is substantially parallel to a floor surface and substantially perpendicular to a gravity plane.

In one example, the lowest level seating riser 12A is a powered seating riser including a drive assembly for driving the riser 12A between the deployed and retracted positions. The drive assembly may optionally laterally steer the risers 12A-12F during deployment and retraction. In another example, such as that discussed relative to FIGS. 11-14, the risers 12A-12F deploy and retract along tracks. Movement of the lowest level riser 12A moves the remaining risers 12B-12F in series. While six seating risers 12A-12F are shown, it should be understood that this disclosure extends the seating systems with any number of risers, including systems with only a single riser.

Figure 1C:
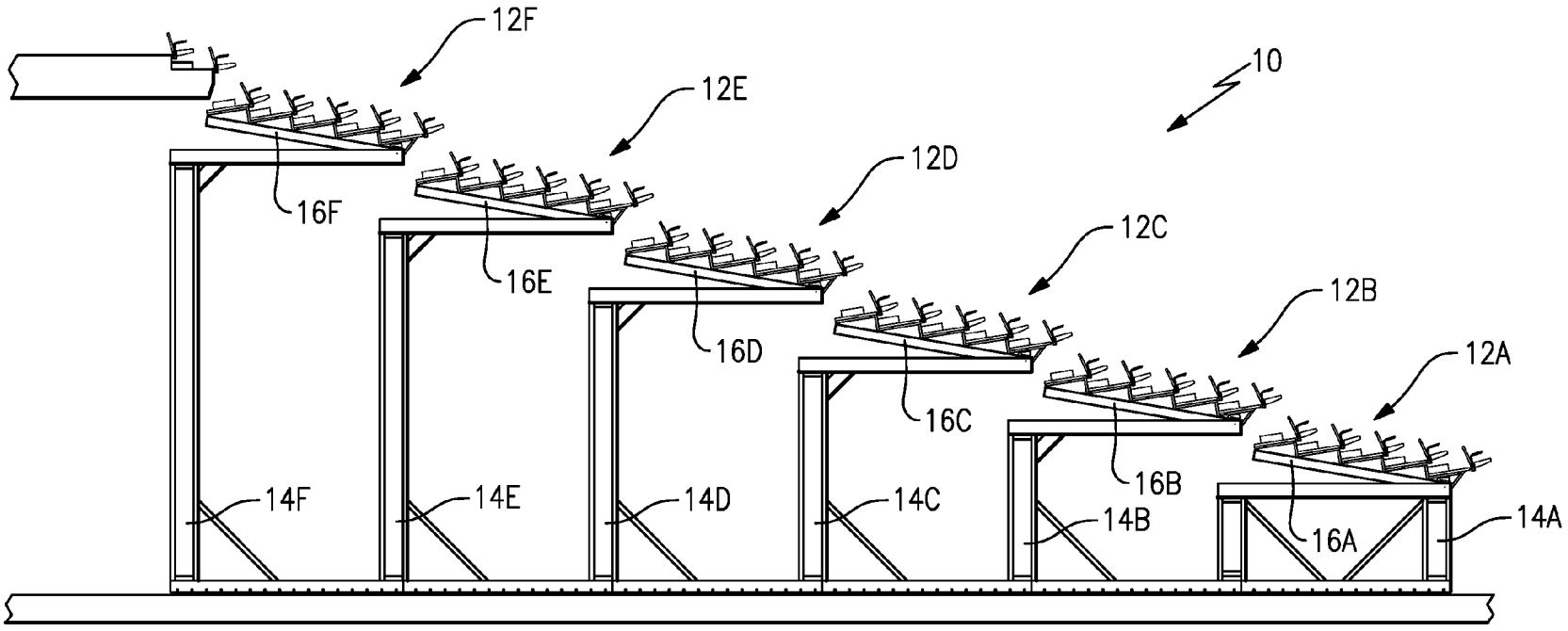
FIG. 1C is a side view of the seating system of FIG. 1A in a deployed position, with the decks of the seating system between a stored position and a use position.

Referring to FIG. 1C, each of the risers 12A-12F includes a support 14A-14F for supporting a deck 16A-16F. In this example, the decks 16A-16F each include a plurality of vertically stepped levels $L_1$-$L_5$ (see FIGS. 2-3). In one example, each of the levels $L_1$-$L_5$ includes a row of affixed seats. In other examples, however, the levels $L_1$-$L_5$ do not include fixed seats.

Figure 1D:
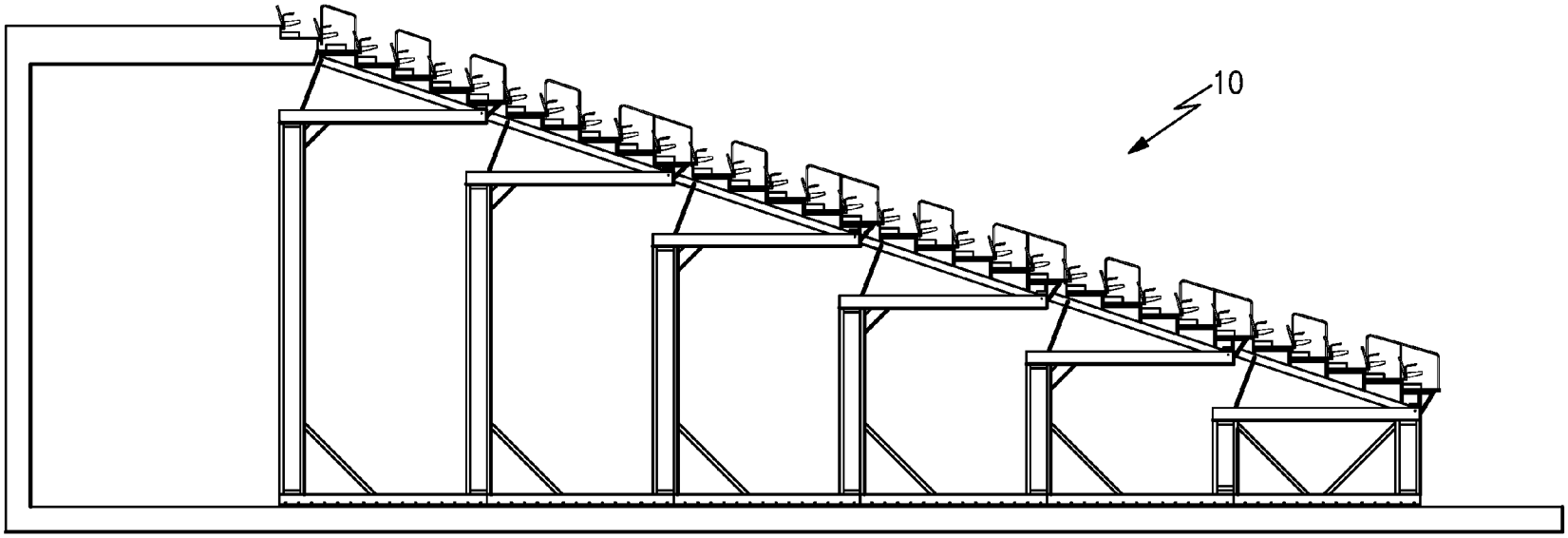
FIG. 1D is a side view of the seating system of FIG. 1A in a deployed position, with the decks of the seating system in use position.
Figure 1E:
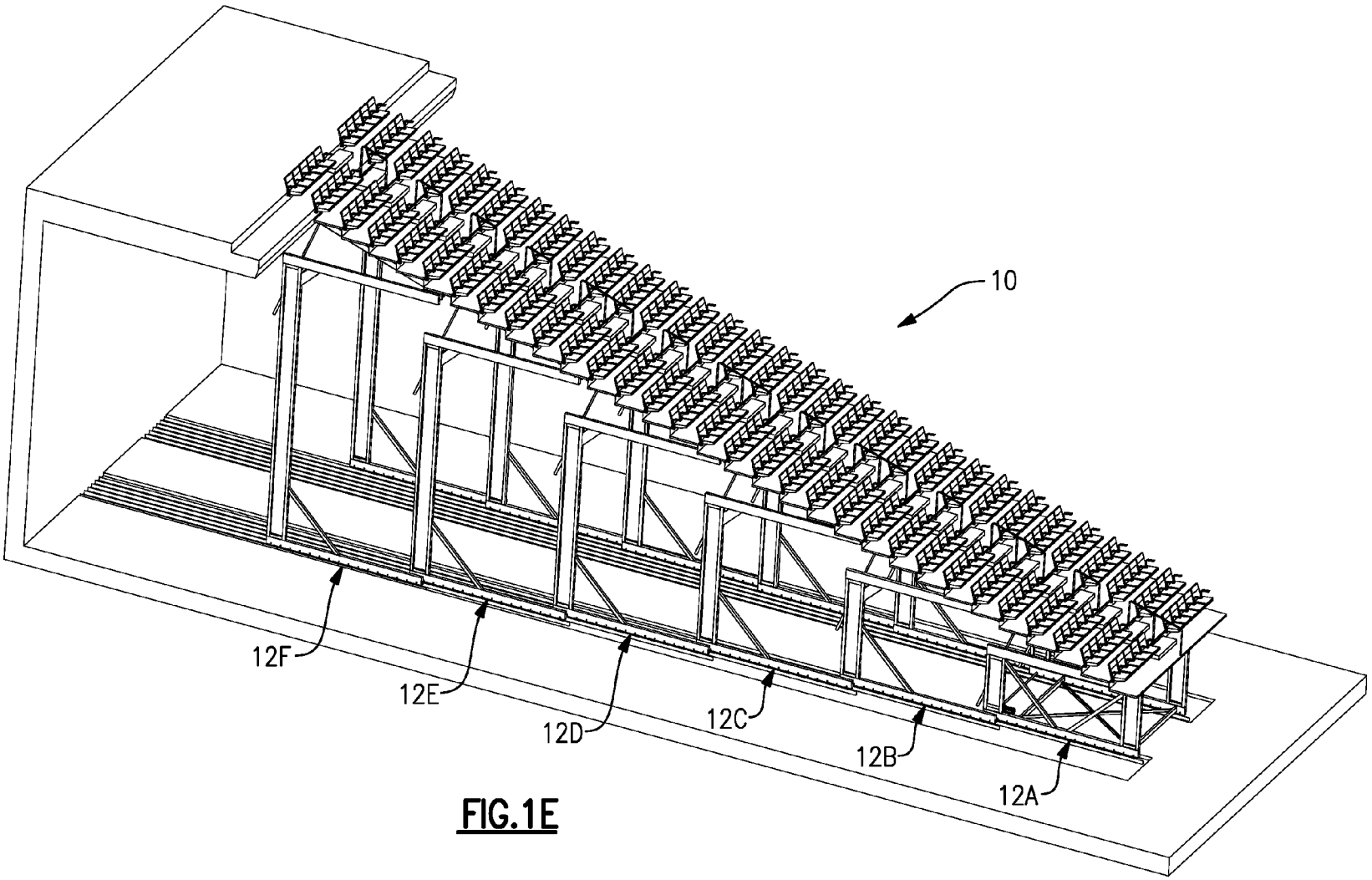
FIG. 1E is a side-perspective view of the seating system of FIG. 1A in a deployed position, with the decks of the seating system in a use position.
Figure 2:
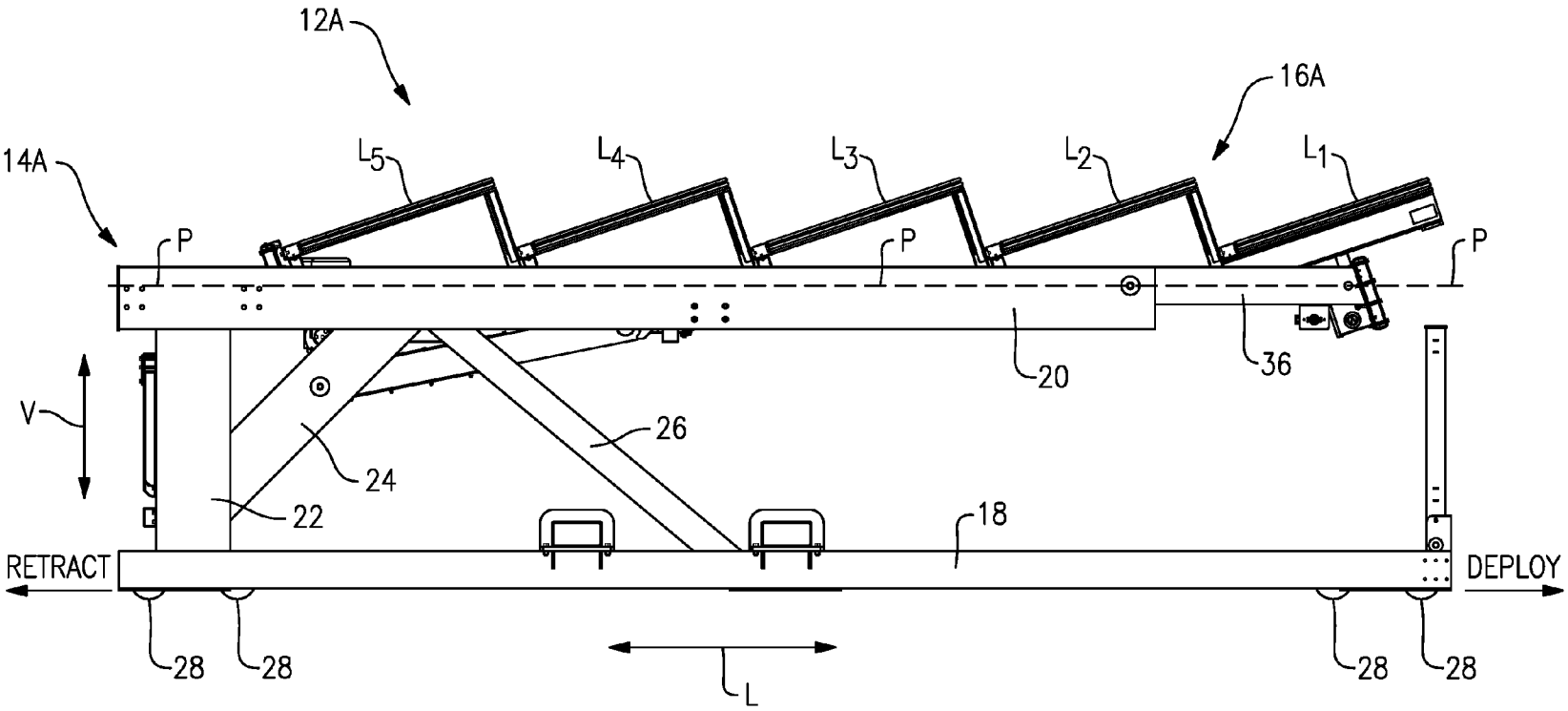
FIG. 2 is a side view of a seating riser with a deck in the stored position.
Figure 3:
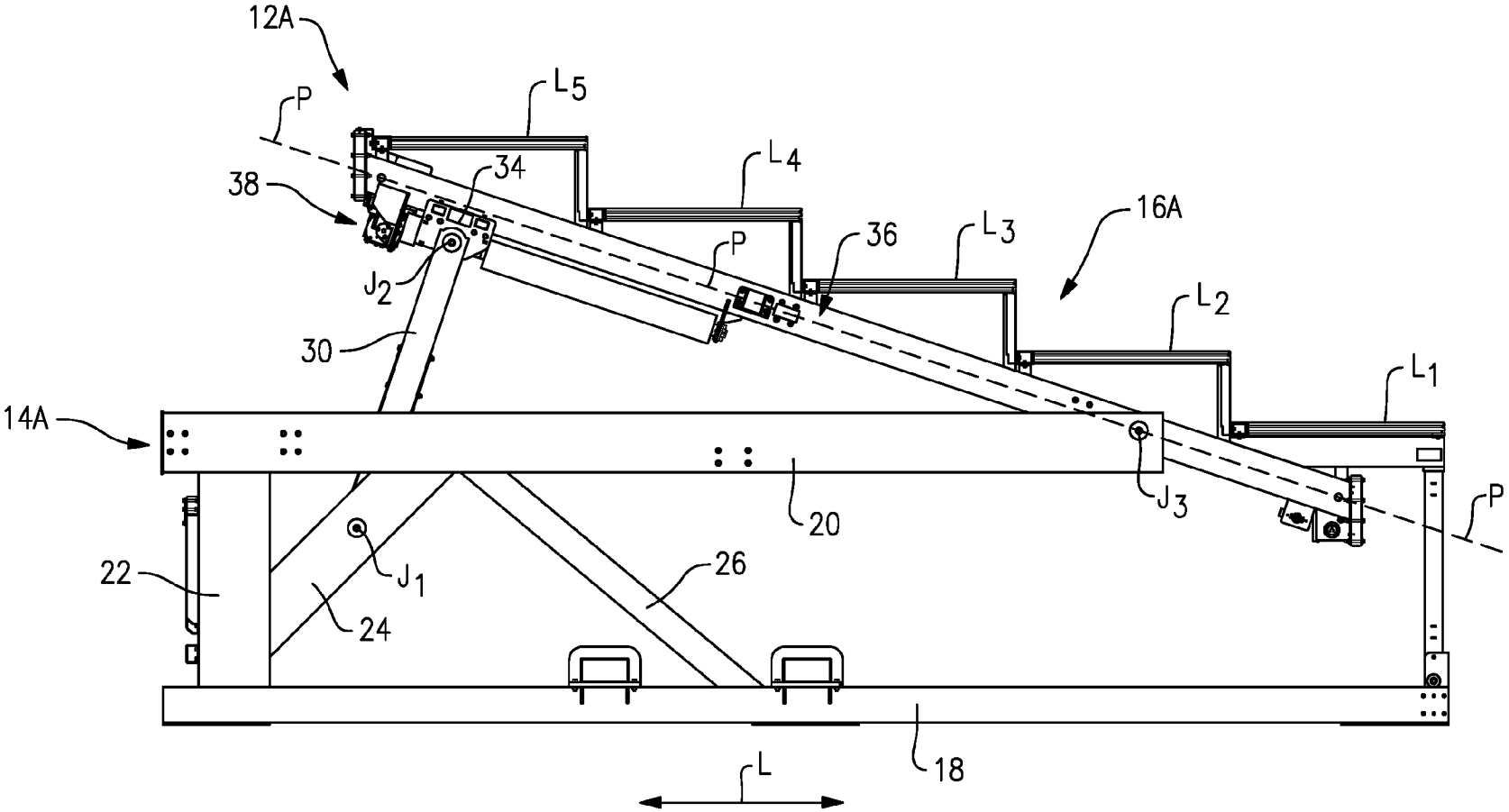
FIG. 3 is a side view of the seating riser of FIG. 2 with the deck in the use position.

As will be explained below, the decks 16A-16F are tiltable between a "stored" position (FIGS. 1A-1B and FIG. 2) and a "use" position (FIGS. 1D-E and FIG. 3). FIG. 1C illustrates the decks 16A-16F between the "use" position and "stored" positions.

FIG. 2 illustrates an example seating riser 12A with a deck 16A in a "stored" position. It should be understood that the riser 12A is representative of the remainder of the risers in the seating system 10. Further, many of the views (such as FIGS. 2-3) of the seating riser 12A are side views, and therefore it should be understood that the structure in these view may be essentially mirrored on the opposite side of the seating riser 12A.

The riser 12A includes a support 14A configured to support a deck 16A. In this example, the support 14A includes lower and upper longitudinal supports 18, 20 extending in the longitudinal direction L. The lower longitudinal support 18 is spaced apart from the upper longitudinal support 20 in a vertical direction V, which is normal to the longitudinal direction L. The upper longitudinal support 20 is supported in this example by a first vertical support 22 and first and second cross supports 24, 26. The lower longitudinal support 18 may include a plurality of rollers 28 (such as wheels), which are configured to allow the riser 12A to deploy and retract relative to a ground surface or a track, as examples.

FIG. 3 illustrates the riser 12A with the deck 16A in the "use" position. When in the "use" position, the deck 16A is aligned with a deck from an adjacent riser (that is also in the "use" position). In this example, a first support arm 30 extends between a first pivot $J_1$ provided relative to the first cross support 24 and a second pivot $J_2$ on a trolley 34 mounted to adjacent a rear of the deck 16A. A third pivot $J_3$ is provided adjacent a forward end of the riser 12A, between the upper longitudinal support 20 and the deck 16A at a location forward of the first and second pivots $J_1$, $J_2$.

The deck 16A includes a deck stringer 36, which defines a deck plane P. In the stored position (FIG. 2), the deck plane P lies in substantially a true horizontal plane. The deck 16A is configured to be tilted relative to this horizontal position, about the joint $J_3$, in response to an actuator 38.

Figure 4:
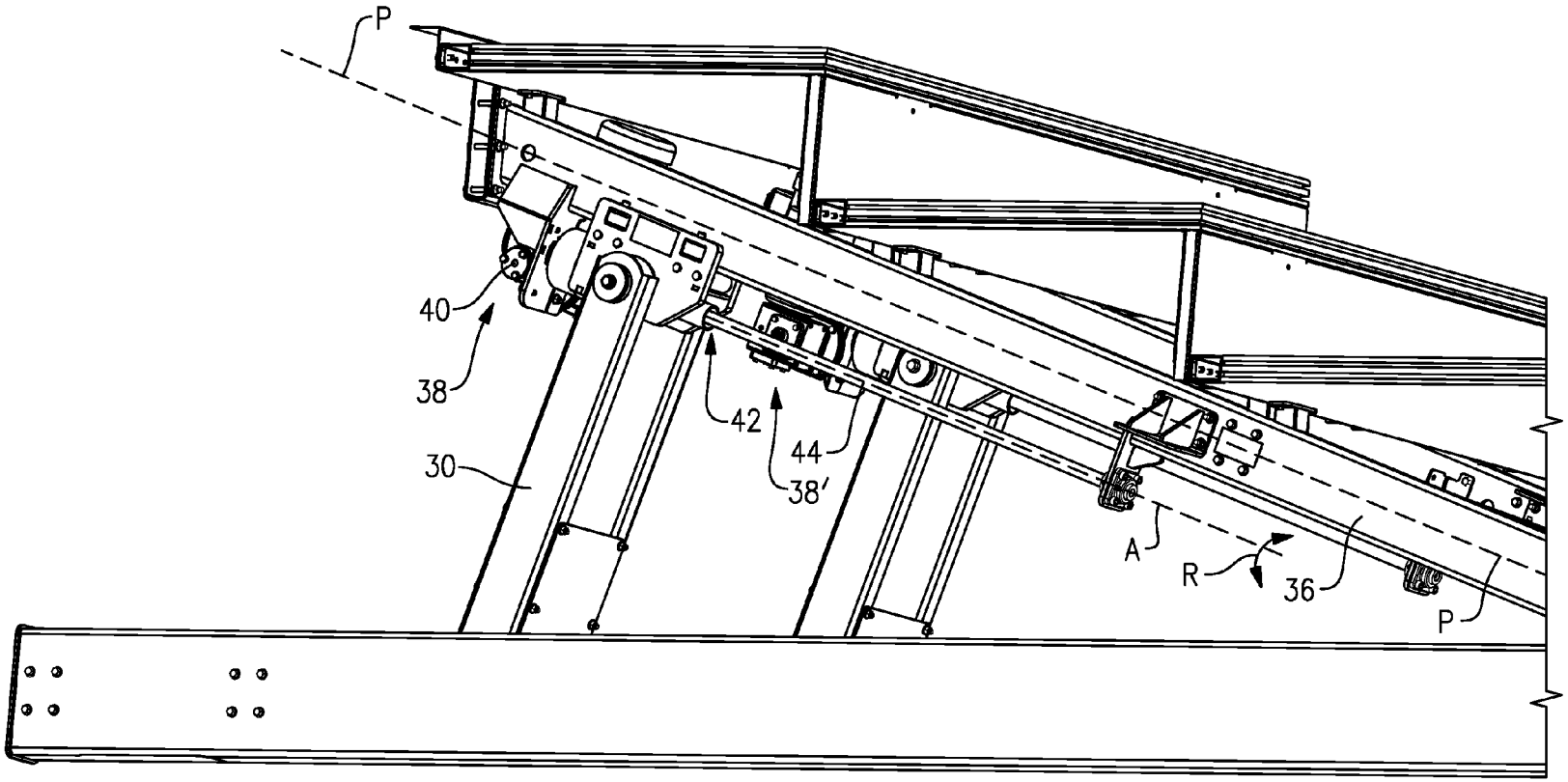
FIG. 4 is an outside perspective view of an example actuator configured to tilt the deck.
Figure 5:
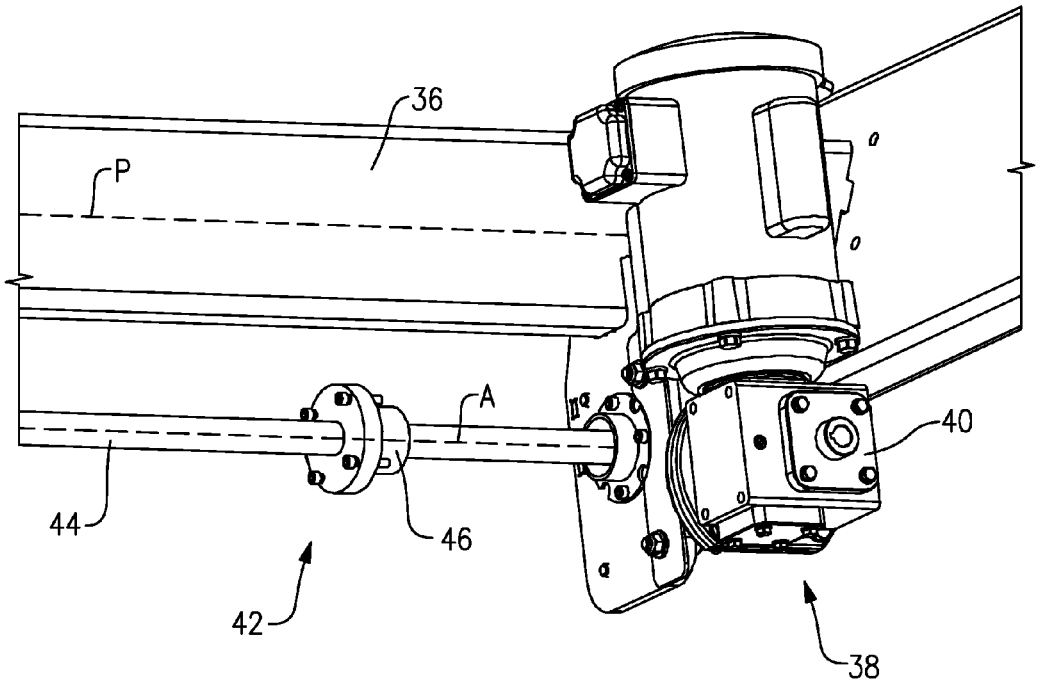
FIG. 5 illustrates the detail of the example actuator of FIG. 4.
Figure 6:
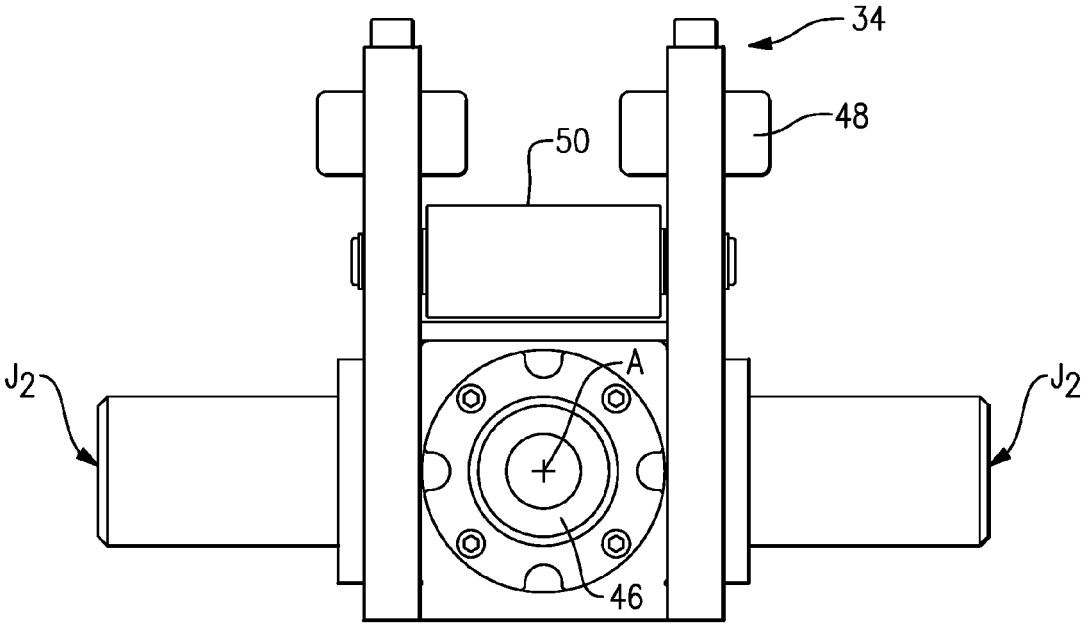
FIG. 6 is an end view illustrating a trolley for use with the actuator of FIG. 4.

The detail of the actuator 38 is illustrated in FIG. 4. The actuator 38, in this example, is a linear actuator. The actuator 38 includes a motor 40 and a ball screw assembly 42. The ball screw assembly 42 includes a ball screw 44 and a ball nut 46 (as seen in FIGS. 5-6). The ball screw 44 is mounted relative to the deck stringer 36 along an axis A. The axis A is substantially parallel to the plane P in this example. Upon actuation of the motor 40, the ball screw 44 is configured to rotate in a direction R about the rotation axis A.

The motor 40 is configured to lock the ball screw 44 in place, and prevent rotation thereof to lock the deck 16A in position. In other examples, the deck 16A may cooperate with a separate lock to maintain the deck 16A in the "use" and "stored" positions.

Figure 7:
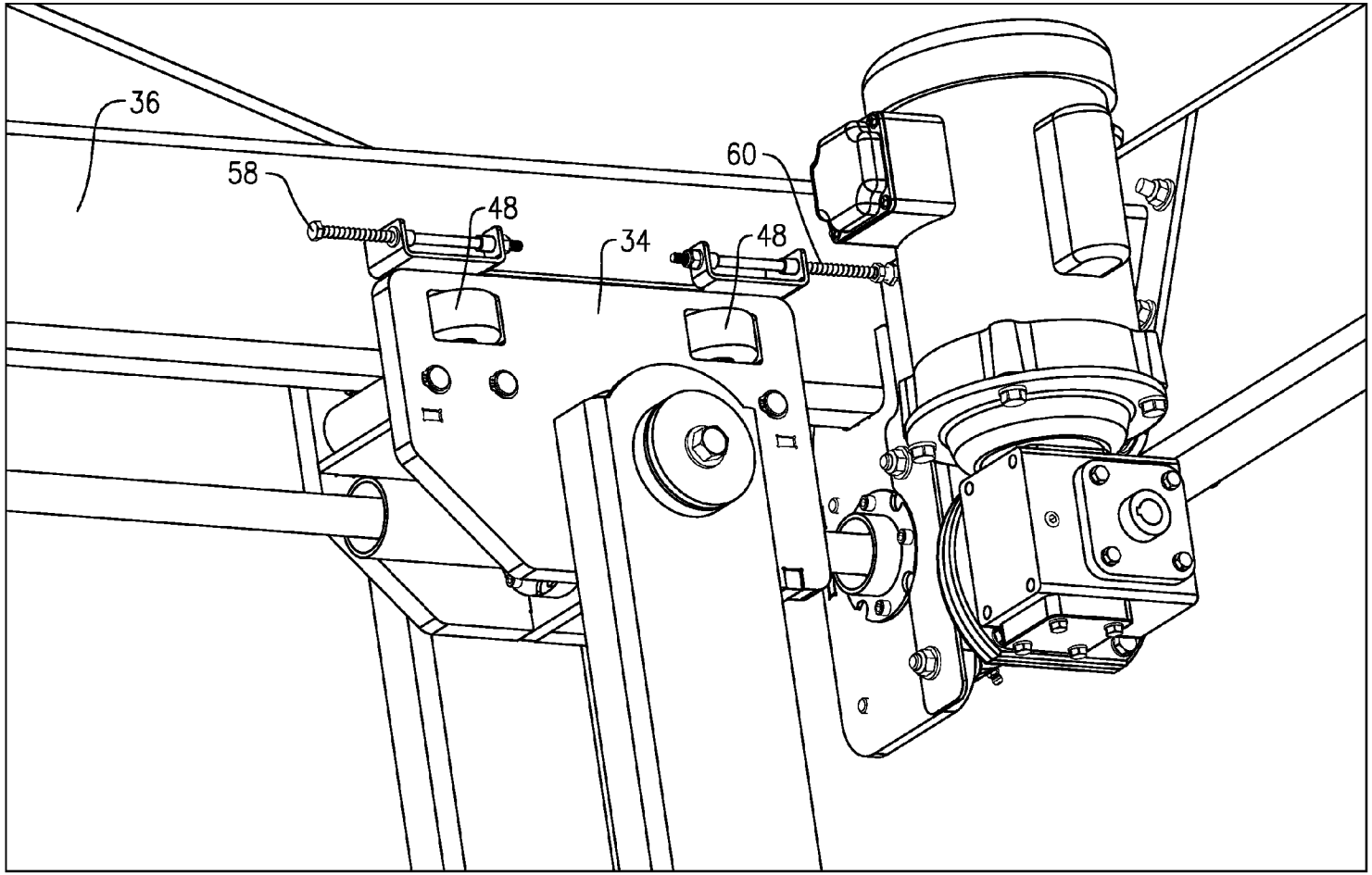
FIG. 7 is an inside perspective view of the example actuator of FIG. 4.

As perhaps best seen in FIGS. 6-7, the ball nut 46 is mounted relative to the trolley 34 such that the ball nut 46 is prevented from rotating about the axis A. Thus, rotation of the ball screw 44 relative to the ball nut 46 translates into linear movement of the ball nut 46 and, in turn, the trolley 34 along the axis A.

The ball nut 46 is mounted relative to the trolley 34 such that the trolley 34 is guided along the deck stringer 36 by way of side rollers 48 and vertical rollers 50. As the trolley 34 travels rearward along the axis A, the deck 16A tilts about the joint $J_3$ and moves into the "use" position. While not illustrated, a control unit may be in communication (e.g., wirelessly or otherwise) with the actuator 38 to selectively control tilting of the deck 16A.

In order to protect the ball screw assembly 42, a bellows 52 (shown in FIG. 8), which is compressible along the axis A, may be placed around the ball screw 44 to prevent debris from interfering with the ball screw assembly 42.

Figure 8:
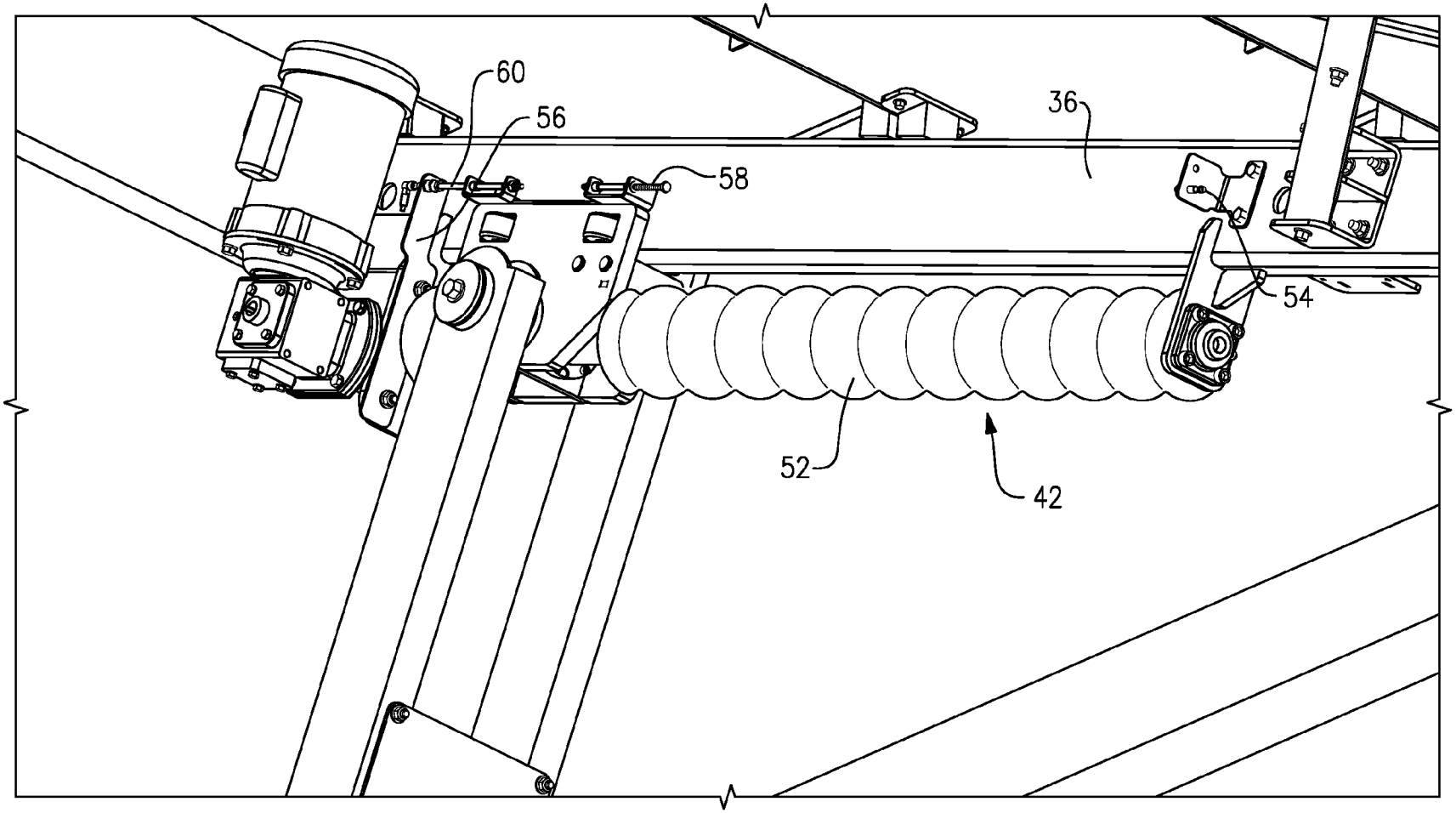
FIG. 8 illustrates a bellows associated with the example actuator of FIG. 4.

Further, as shown in FIG. 8, the deck stringer 36 may include stoppers 54, 56 configured to abut axial limiters 58, 60 provided adjacent the axial ends of the trolley 34 to prevent movement of the deck 16A beyond either the used position or the stored position.

While a particular actuator 38 has been illustrated and described herein, it should be understood that other types of actuators (e.g., linear actuators that do not include ballscrews, and non-linear actuators) come within the scope of this disclosure. Further, while only one actuator 38 has been described, each riser may include additional actuators (e.g., in FIG. 4, the riser 12A is shown with two actuators 38, 38').

Providing a tiltable deck such as that described above increases the availability of seating, while reducing the vertical storage space required to store the seating system.

Figure 9:
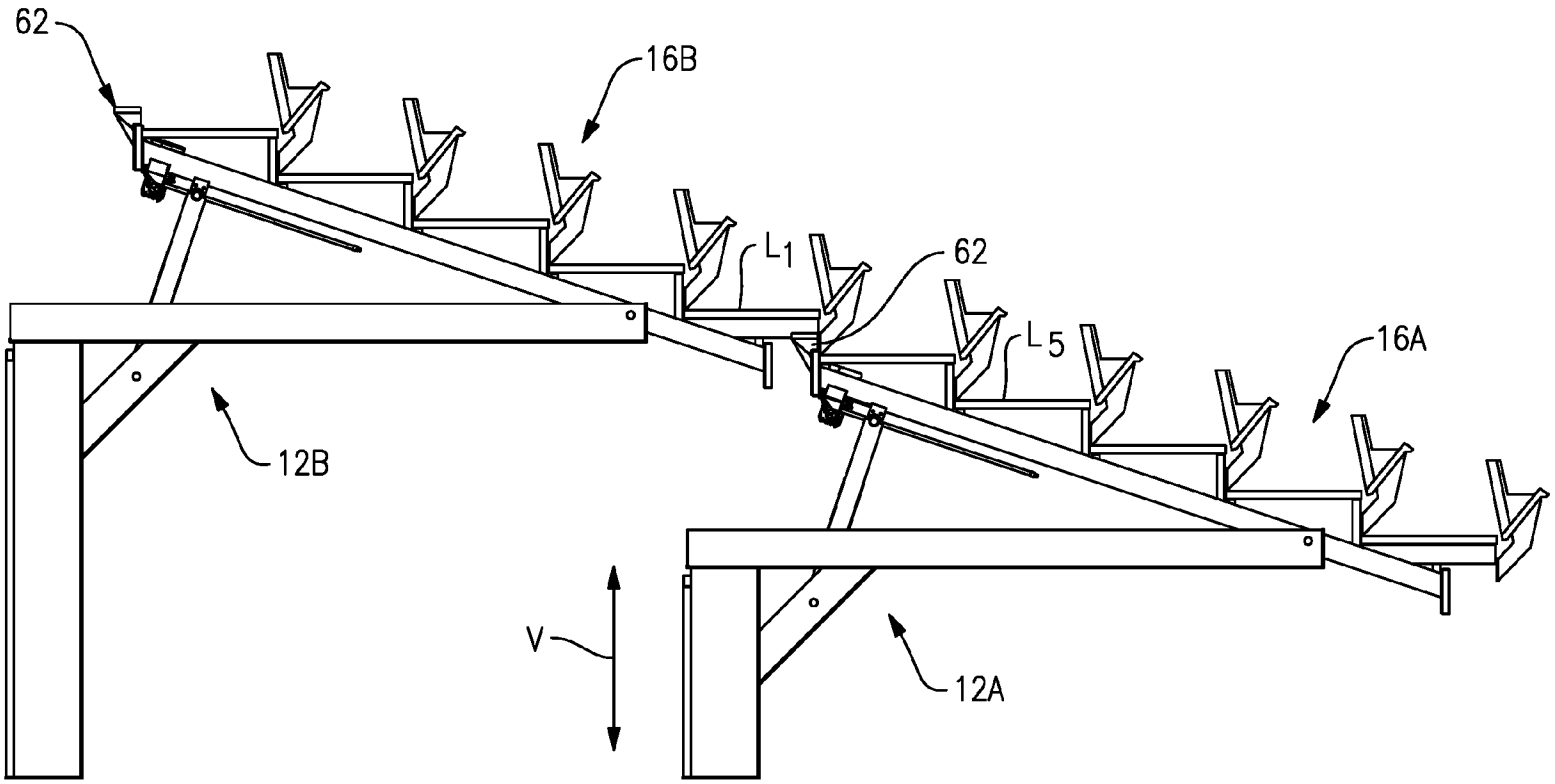
FIG. 9 is a side view of two adjacent risers, and illustrates a support bracket between the two risers.
Figure 10:
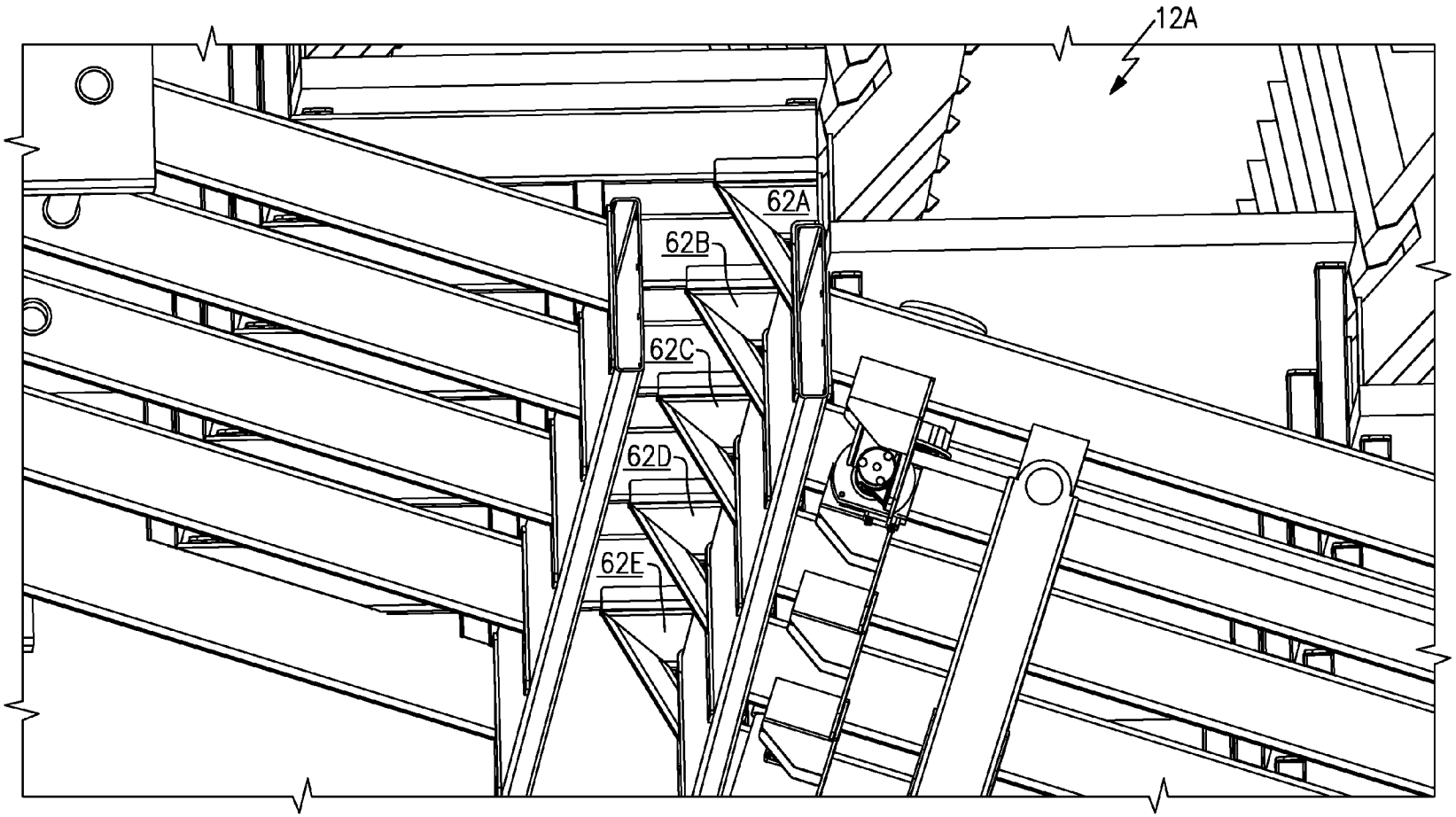
FIG. 10 illustrates a plurality of support brackets between two adjacent risers.

As illustrated in FIGS. 9-10, the lowest level $L_1$ of the higher level deck 16B may be supported on a support bracket 62 extending upwardly, in the vertical direction V, relative to the highest level $L_5$ of a lower level deck 16A for increased stability. Each riser may include more than one support bracket, as illustrated in the example of FIG. 10, which includes five support brackets 62A-62E.

Figure 11:
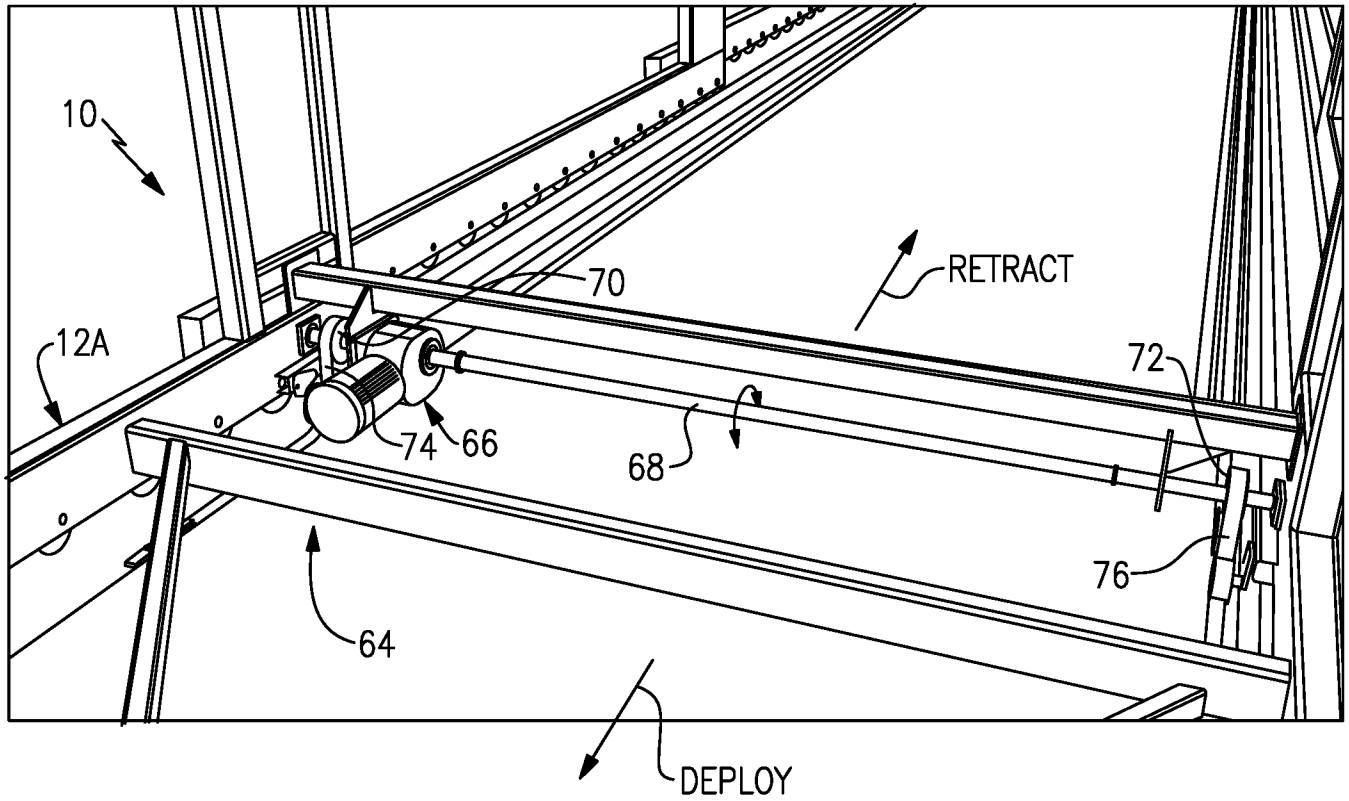
FIG. 11 illustrates an example drive system.

FIG. 11 illustrates a drive system 64 for use with the seating system 10. The illustrated drive system 64 may be used with other seating systems, however. In this example, the lowest level riser 12A includes a motor and gearbox 66 connected, by way of a shaft 68, to two drive sprockets 70, 72 on opposed lateral sides of the riser 12A. The drive sprockets 70, 72 each engage a respective belt 74, 76 to drive the seating riser in the forward and rearward directions.

Figure 12:
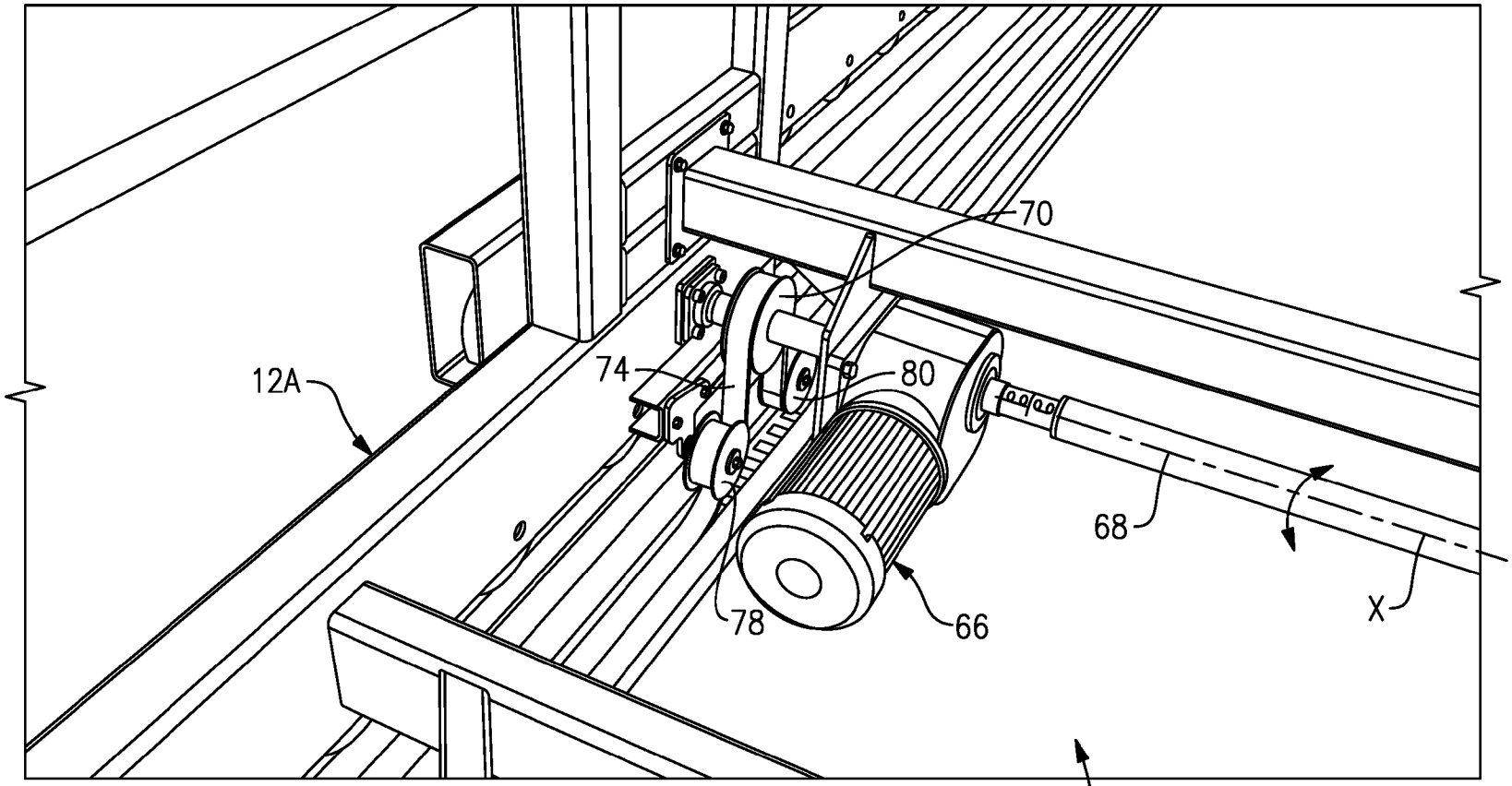
FIG. 12 illustrates the detail of the example drive system of FIG. 11.
Figure 13:
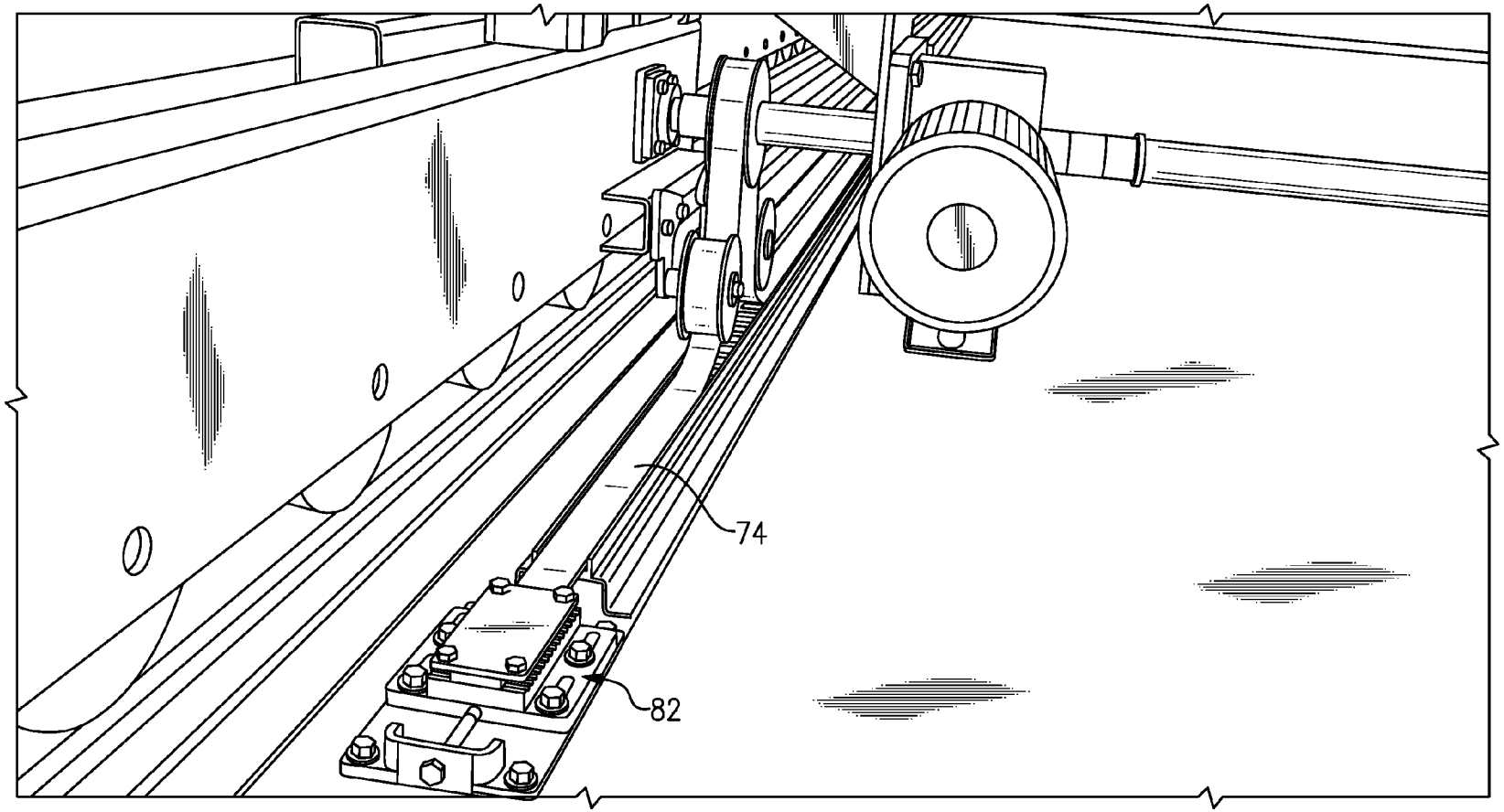
FIG. 13 illustrates a clamping block associated with the example drive system of FIG. 11.

With reference to FIG. 12, the arrangement between the drive sprocket 70 and the belt 74 is illustrated. In this example, the shaft 68 is configured to rotate the drive sprocket 70 about an axis X. Further, two idler pulleys 78, 80 are positioned vertically below the axis X, and provide tension relative to the belt 74 so that the belt sufficiently engages the sprocket 70. In this example, the belt 74 is fixed in place by way of clamping blocks 82 (FIG. 13) provided at each end of the belt 74. Thus, rotation of the sprocket 70 moves the lower level riser 12A in the forward and rearward directions along the belt 74. While FIGS. 12-13 illustrate one side of the riser 12A, the opposite side of the riser 12A may include a similar drive-sprocket/belt/idler-pulley arrangement to that shown in FIGS. 12-13.

Figure 14:
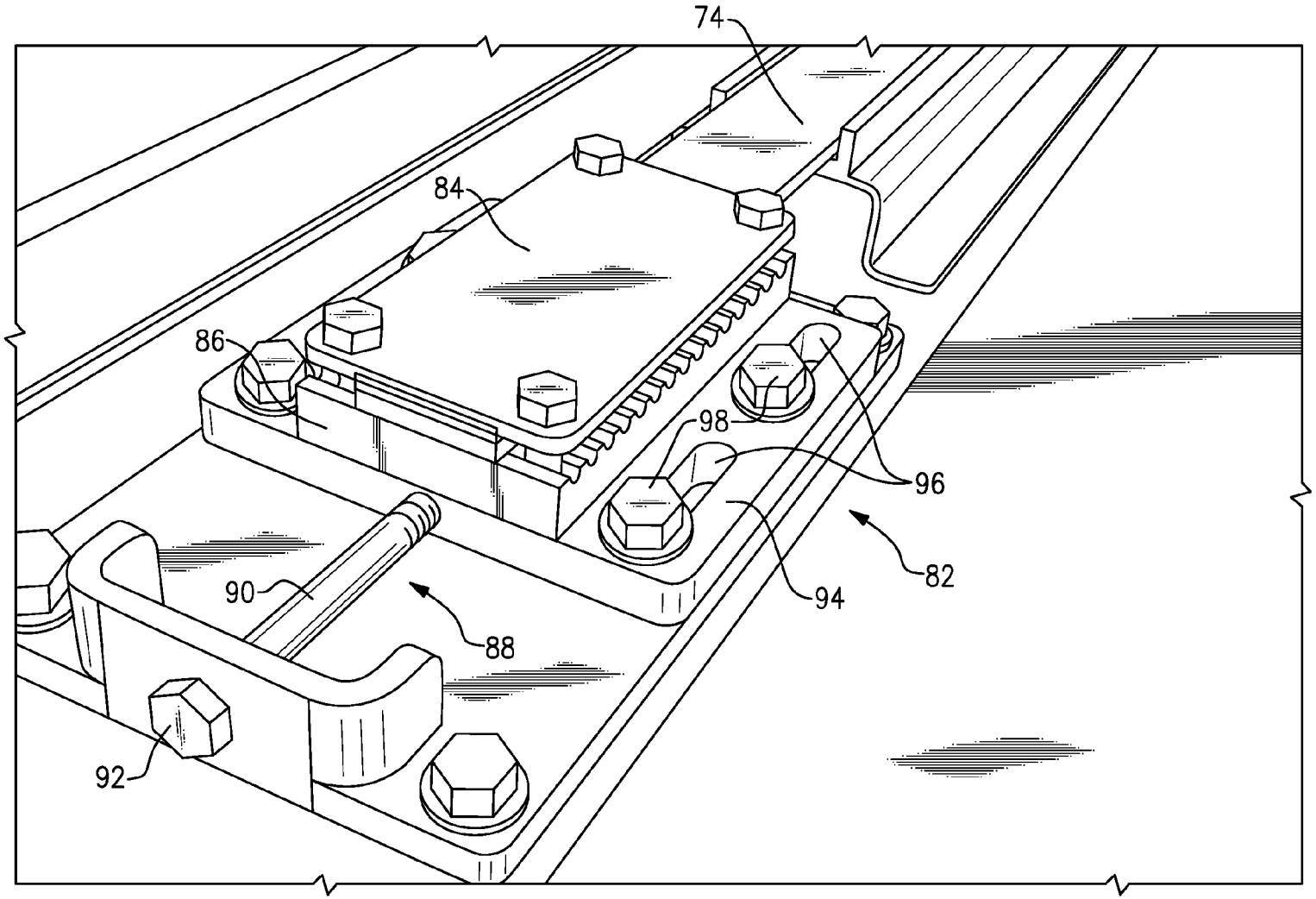
FIG. 14 illustrates the detail of the clamping block of FIG. 13.

The clamping blocks 82 may be positioned at each end of each of the belts 74, 76 to maintain tension in the belt 74. FIGS. 14 illustrates the detail of one of the clamping blocks 82. As illustrated, the belt 74 is clamped between plates 84, 86, and may be longitudinally adjusted by way of an adjuster 88.

In this example, the adjuster 88 includes a bolt having a threaded shaft 90 and a head 92. Opposite the head 92, the threaded shaft 90 is attached to a slotted plate 94 supporting the plates 84, 86. The slotted plate 94 includes longitudinal slots 96 receiving fasteners 98. The length of the slots 96 is longer than the diameter of the shafts of the fasteners 98, which allows longitudinal movement of the adjuster 88. This movement in turn adjusts the tension in the belt 74.

While not illustrated herein, the belts 74 may include teeth on one side thereof, to engage the drive sprocket 70. The drive sprocket 70 may include notches corresponding to the teeth in the belt. This relationship may increase force transfer between the drive sprocket 70 and the belt 74.

While a particular drive system 64 is illustrated across FIGS. 11-14, other drive systems may be included herein. For instance, seating system 10 may include a rack and pinion drive, a cogged wheel/slotted track drive, a continuous cable and rigid chain drive, to name a few.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A seating system, comprising:

a riser including a tiltable deck, wherein the deck is tiltable between a stored position and a use position, wherein the deck is substantially perpendicular to a gravity plane when in a stored position, and wherein, when in the use position, the deck is inclined at an acute angle relative to the position of the deck in the stored position, wherein the riser is one of a plurality of risers configured to telescope relative to one another.

2. The seating system as recited in claim 1, further comprising an actuator operable to selectively tilt the deck.

3. The seating system as recited in claim 2, wherein the deck tilts about a pivot adjacent a forward end of the riser.

4. The seating system as recited in claim 2, wherein the actuator is mounted to a stringer supporting the deck.

5. A seating system, comprising:

a riser including a tillable deck, wherein the deck is tillable between a stored position and a use position, wherein the deck is substantially perpendicular to a gravity plane when in a stored position, and wherein, when in the use position, the deck is inclined at an acute angle relative to the position of the deck in the stored position; and an actuator operable to selectively tilt the deck, wherein the actuator is mounted to a stringer supporting the deck, and wherein a support arm extends between the stringer and a riser support.

6. The seating system as recited in claim 5, wherein the riser support is a cross support between a first longitudinal support and a second longitudinal support.

7. The seating system as recited in claim 6, wherein the stringer is pivotably connected to the upper longitudinal support, the support arm is pivotably connected to the cross support, and the support arm is pivotably connected to the actuator.

8. A seating system, comprising:

a riser including a tiltable deck, wherein the deck is tiltable between a stored position and a use position, wherein the deck is substantially perpendicular to a gravity plane when in a stored position, and wherein, when in the use position, the deck is inclined at an acute angle relative to the position of the deck in the stored position; and an actuator operable to selectively tilt the deck, wherein the deck tilts about a pivot adjacent a forward end of the riser, and wherein the actuator includes a motor operable to rotate a ball nut relative to a ball screw.

9. The seating system as recited in claim 8, wherein rotation of the ball screw relative to the ball nut moves the ball nut along the length of a deck stringer.

10. The seating system as recited in claim 9, wherein a trolley is connected to the ball nut, the trolley including a plurality of rollers configured to guide the trolley relative to the deck stringer.

11. The seating system as recited in claim 10, wherein the deck stringer includes a first stopper and a second stopper, and wherein the trolley includes first and second limiters configured to engage the first and second stoppers to limit the movement of the deck.

12. A seating system, comprising:

a drive system for moving a riser, the drive system including a sprocket configured to engage a belt; and a first clamping block and a second clamping block, the first and second clamping blocks provided adjacent respective ends of the belt;

wherein at least one of the first and second clamping blocks is configured to adjust a tension in the belt;

wherein the at least one of the first and second clamping blocks includes an upper plate and a lower plate, each of the upper and lower plates supported on a slotted plate having a plurality of slots therein, the slots allowing for movement of the slotted plate relative to a plurality of fasteners to adjust the tension in the belt.

13. The seating system as recited in claim 12, wherein the drive system includes a motor operable to rotate the sprocket.

14. The seating system as recited in claim 12, wherein the drive system includes a first idler pulley and a second idler pulley on opposed sides of the sprocket, each of the first and second idler pulleys configured to engage the belt.

15. The seating system as recited in claim 12, wherein the riser includes a tiltable deck.

* * * * *